United States Patent [19]

Güttler et al.

[11] Patent Number: 4,570,429

[45] Date of Patent: Feb. 18, 1986

[54] THREAD GUARD FOR SPINNING OR TWISTING MACHINE

[75] Inventors: Hermann Güttler, Uhingen; Bernd Lagemann, Göppingen, both of Fed. Rep. of Germany

[73] Assignee: Zinser Textilmaschinen GmbH, Ebersbach/Fils, Fed. Rep. of Germany

[21] Appl. No.: 465,922

[22] Filed: Feb. 14, 1983

[30] Foreign Application Priority Data

Feb. 12, 1982 [DE] Fed. Rep. of Germany ..... 3204936

[51] Int. Cl.[4] ..... D01H 13/16; D01H 13/18

[52] U.S. Cl. ..... 57/81; 57/80; 57/86; 57/87

[58] Field of Search ..... 57/78, 80, 81, 86, 87

[56] References Cited

U.S. PATENT DOCUMENTS

| | | | |
|---|---|---|---|
| 2,494,490 | 1/1950 | Rinehart et al. | 57/86 |
| 3,163,341 | 12/1964 | Fisher et al. | 57/80 X |
| 3,759,026 | 9/1973 | Hope | 57/80 |
| 4,110,963 | 9/1978 | Plate et al. | 57/86 |
| 4,292,798 | 10/1981 | Gore et al. | 57/86 |
| 4,444,005 | 4/1984 | Klein et al. | 57/81 X |

FOREIGN PATENT DOCUMENTS

| | | |
|---|---|---|
| 7912423 | 8/1979 | Fed. Rep. of Germany . |
| 3114919 | 10/1982 | Fed. Rep. of Germany . |

*Primary Examiner*—John Petrakes

*Attorney, Agent, or Firm*—Karl F. Ross; Herbert Dubno

[57] ABSTRACT

A device attached to a spinning or twisting machine, designed to monitor the integrity of two threads merging under tension into a yarn, has a carrier swingable about a horizontal axis and provided with a thread guide, such as a pair of parallel pins, bracketing the yarn downstream of the merger point. A rupture of either thread lets the carrier rotate, e.g. by gravity, from an unstable normal position by half a turn into a stable off-normal position to impede the advance of the remaining intact thread whereby the latter also breaks. Such action, however, is prevented when the yarn is under reduced tension, as during shutdown or startup of the machine, by a locking mechanism arresting the carrier in its normal position. The locking mechanism may include an electromagnet whose winding can form part of a circuit signaling the displacement of the carrier into its off-normal position in response to a thread break.

20 Claims, 12 Drawing Figures

THREAD GUARD FOR SPINNING OR TWISTING MACHINE

FIELD OF THE INVENTION

Our present invention relates to a device, referred to hereinafter as a thread guard, which is attached to a spinning or twisting machine for the purpose of monitoring the integrity of two threads merging into a yarn under tension exerted thereon by a bobbin-carrying spindle, a take-up reel or other drawing means disposed downstream of the thread junction. The threads merged at that junction need not be individual filaments but could also be, for example, slivers advanced by feed rollers of a draw frame.

BACKGROUND OF THE INVENTION

If either of the contributing threads should break upstream of the merger point, the remaining thread would continue for some time to be pulled by the drawing means to produce a defective length of yarn even if the machine were promptly deactivated—manually or automatically—in response to a signal from a sensor detecting the break. It is therefore desirable that a thread guard have means responsive to a rupture of either thread for quickly breaking the other thread in order to prevent the wasting of a significant portion of that thread and to avoid the production of a defective yarn section. Thus, German utility model No. GM 79 12 423 discloses a thread guard of this nature comprising a swingable member disposed just downstream of a thread junction for guiding engagement with the yarn in a normal position of that member from which it is limitedly displaceable to one side or the other by minor differences in the tension of the contributing threads. When this difference exceeds a certain threshold, as will be the case in the event of a thread rupture, the guide member is deflected into an off-normal position in which it impedes the advance of the intact thread so as to cause its rupture. In a specific instance, the guide member is balanced on a horizontal pin and its normal position is metastable so that gravity makes it rotate through 180° when the limits of lateral deflection are surpassed whereby two pins bracketing the yarn invert their relative position to entangle the remaining thread. Also mentioned is the possibility that gravity be replaced by some other stored forces, such as the stress of a spring or an electromagnetic field, to create something like a toggle effect when the guided yarn strongly deviates from its regular path. In any event, the yarn is guided with considerable lateral play by the swingable member in its metastable normal position.

In our copending application Ser. No. 443,561, filed Nov. 22, 1982, now U.S. Pat. No. 4,472,932, we have disclosed an improvement over the subject matter of the above-identified German utility model according to which a carrier rotatable about an axis perpendicular to the path of the yarn and provided with guide means bracketing the yarn in a working position as known from the German publication, is normally immobilized in that working position by detent means deactivable by drive means responsive to detection of a thread break whereupon the carrier is rotated about its axis to invert the position of the guide means. The latter may comprise two pins flanking the yarn or an eyelet traversed by same, as known per se from that publication.

Our copending application, whose disclosure we wish to incorporate by reference into the present one, further describes and shows sensing means separate from the rotatable carrier for monitoring the integrity of the threads upstream of their junction and activating the drive means upon detecting a break. We have found, however, that in some instances the thread guard of the German utility model as well as the sensing means of our copending application may respond in an untimely manner to the lack of normal yarn tension during the stopping or the startup of the machine, thereby blocking the advance of the yarn at the beginning of a new operating cycle. Such an undesirable effect may also result from manipulation of the equipment—e.g. cleaning—during standstill of the machine.

OBJECTS OF THE INVENTION

The general object of our present invention, therefore, is to provide means in a textile machine of the type referred to for preventing such untimely response of a thread guard associated with a yarn-feeding mechanism.

A more particular object is to provide means in such a machine for indicating the rupturing of a thread by our improved device.

SUMMARY OF THE INVENTION

We realize this object, in accordance with our present invention, by the provision of locking means on a stationary carrier support for forcibly retaining the rotatable carrier in its above-defined working position when the machine is being shut down or restarted, or more generally whenever the yarn-drawing mechanism operates at substantially less than its normal rate.

In order to activate the normally ineffectual locking means, a switch operatively coupled with the yarn-drawing mechanism is closed or reversed upon a significant slackening of the tension exerted by that mechanism upon the yarn. Such a switch could be simply the one used for turning the machine on and off. This simple solution will immobilize the carrier in its normal or working position, in which the advance of the yarn is not impeded by the flanking pins or other guide means on that carrier, before the yarn tension is significantly reduced at the instant of shutdown. While a malfunction of the thread guard could still occur in such a case when the machine is restarted, several possibilities exist for preventing such a malfunction in the improved thread guard according to our invention. One of them would be the provision of a slow-releasing relay maintaining the locking means operated for a certain period after cut-in, i.e. until the yarn-drawing mechanism—e.g. a bobbin-winding spindle—has reached substantially its full speed. Another, more advantageous way is to provide that mechanism with a speed sensor activating the locking means whenever the operating speed of that mechanism drops below a predetermined threshold.

The locking means according to our invention may comprise a detent engageable with the carrier in response to application of a mechanical, fluidic or electromagnetic force. We prefer, however, to design the locking means as an electromagnet on the carrier support and a coacting armature on the carrier itself. Such an arrangement not only obviates or minimizes the need for additional moving parts but also enables the winding of the electromagnet to be used for sensing a movement of the carrier into its off-normal position in the event of a thread rupture. Thus, the winding may be included in a signaling circuit along with a discriminator responsive to an electrical change induced in the winding by a disalignment of the armature from the electromagnet, the discriminator serving for the triggering of rupture-indicating means designed to alert an operator or to arrest a mechanism (e.g. a draw frame) feeding the slivers or threads to their merger point. The electrical change referred to may be a modification of the winding impedance, due to an increased air gap in the flux path of the electromagnet, or a pulse generated in the winding by the relative motion of the armature if the latter is permanently magnetized. In order to prevent false operation of the discriminator when the winding of the electromagnet is energized, the signaling circuit may include inhibiting means controlled by the activating switch for disabling the discriminator in a state of energization of the winding sufficient to immobilize the carrier in its normal position. A relay operable by a thread-break sensor has been disclosed in German laid-open application No. P 31 14 919 filed Apr. 14, 1981 and owned by the assignee of our present application. The German application, however, does not teach the provision of such a thread-break sensor with an electromagnetic circuit serving to immobilize a rotatable thread guard.

BRIEF DESCRIPTION OF THE DRAWING

The above and other features of our invention will now be described in detail with reference to the accompanying drawing in which.

SPECIFIC DESCRIPTION

Our improved thread guard will be more fully described hereinafter with reference to a thread-breaking device of the type known per se from German utility model No. GM 79 12 423. In principle, however, the present improvement is also applicable to a thread guard of the kind disclosed in our application Ser. No. 443,561 noted above.

Figure 12:
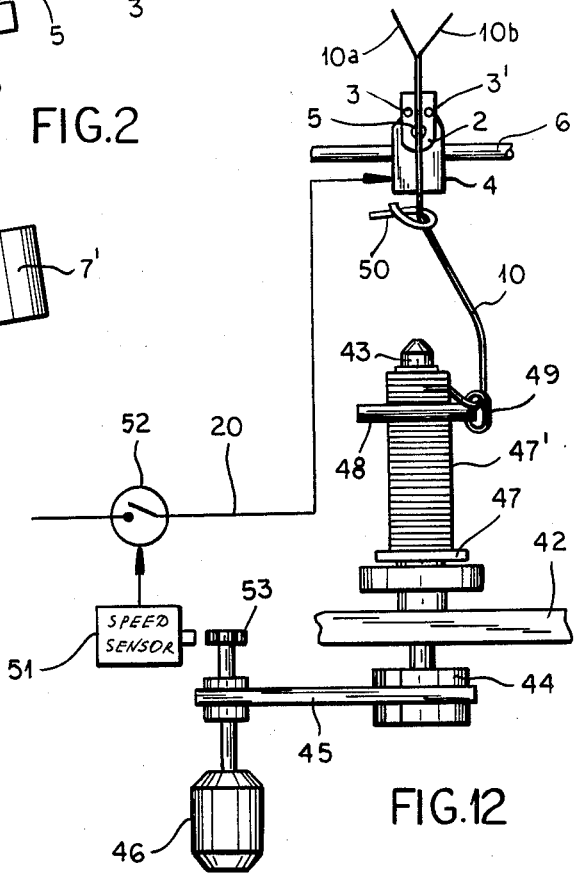
FIG. 12 is a diagrammatic view of part of a textile machine provided with a thread guard according to our invention.

As shown in FIG. 12, this device comprises a stationary support 4 on which a member 2 carrying a pair of parallel guide pins 3, 3' is swingable in a generally vertical plane about an approximately horizontal shaft 5 between an illustrated normal position and an off-normal position spaced therefrom by half a turn. A yarn 10 is composed of two individual threads or slivers **10*a* or 10*b* merging at a junction above support 4, this yarn being spacedly flanked by the pins 3, 3' in the normal position of carrier 2 which can be described as metastable. Upon a rupture of, say, thread 10*a*, the tension of the yarn stretches the other thread 10*b* into a position in which it comes to bear against the adjoining pin—here 3'—to let the carrier 2 swing into its stable inverted position. The tension exerted upon the yarn 10, which passes through an eye 50, comes from a spindle 43 carrying a bobbin 47 on which a yarn package 47' is being wound with the aid of a ring 48 guiding a traveler 49 as is well known in the art. Spindle 43, rotatably mounted on a bar 42 which is vertically reciprocable relatively to traveler ring 49, has a whorl 44 engaged by a belt 45. A motor 46 drives the spindle 43 via belt 45. Support 4 is mounted on a tubular bar 6 also supporting a number of other thread guards, substantially identical with the one illustrated, associated with respective yarn feeders and spindles rising from bar 42. The motor 46 may drive all these spindles, e.g. tangentially, by means of the same belt 45**.

Figure 1:
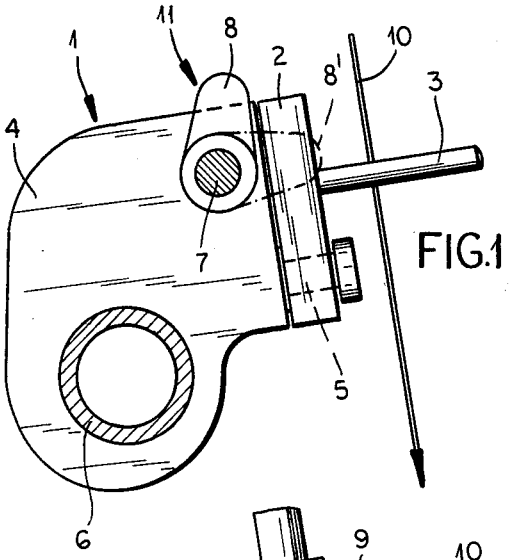
FIG. 1 is a diagrammatic side-elevational view of a thread guard according to our invention provided with mechanical locking means.
Figure 2:
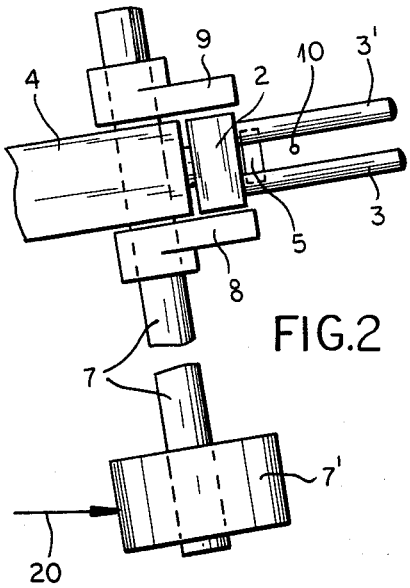
FIG. 2 is a top view of the assembly of FIG. 1.

An embodiment of our invention is shown in FIGS. 1 and 2 in which the carrier 2 of a thread guard 1 is flanked by a pair of lugs 8 and 9 forming part of a detent mechanism 11. The lugs 8 and 9 are secured to a shaft 7 which extends parallel to bar 6 along the entire array of parallel thread guards referred to in connection with FIG. 12. Shaft 7, traversing the support 4, is rotatable through about 60° by a servomotor 7' which may comprise an electromagnet energizable via a conductor 20 from a switch common to all the thread guards as described hereinafter. In the unoperated position of servomotor 7', shaft 7 is maintained (e.g. by a spring) in a position in which the lugs 8 and 9 are withdrawn from the plane of rotation of carrier 2 as illustrated in full lines in FIG. 1. When an activating command is given to servomotor 7', shaft 7 is rotated clockwise to let the lugs swing into a blocking position indicated in phantom lines at 8' for the lug 8. In the latter position, which is also the one illustrated in FIG. 2, carrier 2 is virtually immobilized in its normal metastable position allowing the yarn 10 to pass freely between pins 3 and 3'. This blocking action occurs only when the machine is being stopped or restarted, as discussed above, in which case the supply conductor 20 is energizable by an ON/OFF or START/STOP switch 40 shown in FIGS. 4 and 9–11. Alternatively, or in addition, this conductor could be energized by a switch 52 under the control of a speed sensor 51 which monitors the operation of drive motor 46 as illustrated in FIG. 12. Thus, for example, switch 52 may be closed when the motor speed drops below 75% of its rated value.

Figure 3:
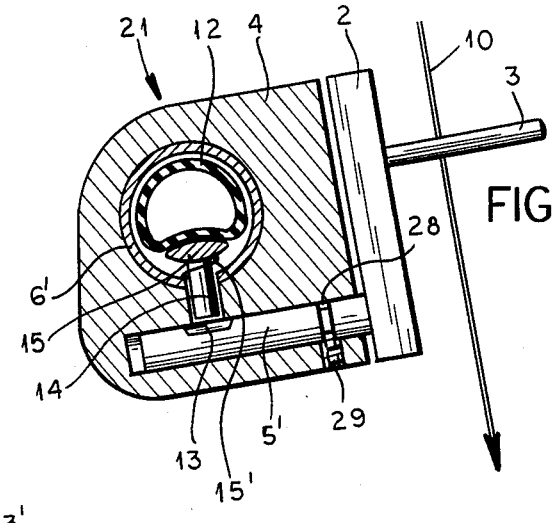
FIG. 3 is a view, partly in section, of a device similar to that of FIGS. 1 and 2 but including a pneumatically operated detent.

FIG. 3 shows a detent mechanism 21 in which the pivot shaft 5' of pin carrier 2 can be retained in the normal position of that carrier by a pin 14 engageable in a depression 13 of that shaft. In this embodiment the activating shaft 7 of FIGS. 1 and 2 is replaced by a throughgoing tube 12 of rubber or other resilient material bearing upon a head 15 of pin 14 which is normally held retracted from shaft 5' by a spring 15'. When the carriers 2 of all parallel thread guards are to be immobilized, tube 12—shown to be lodged in a mounting bar 6'—is inflated with the aid of a nonillustrated air blower to press all the indexing pins 14 into their locking position. Shaft 5' is secured against removal from its bearing by a gub screw 29 engaging in a peripheral groove 28 thereof.

Figure 4:
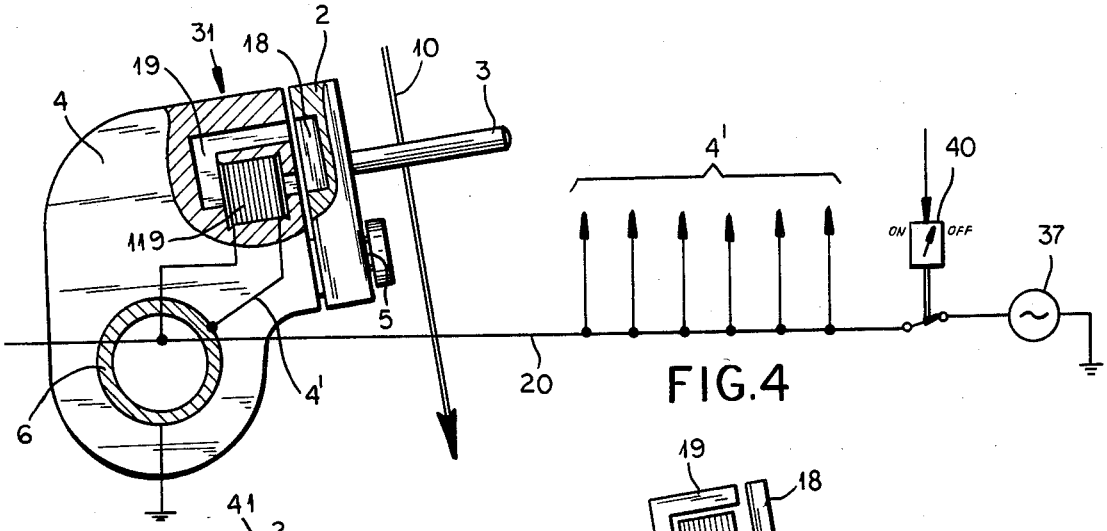
FIG. 4 is a further view similar to FIGS. 1 and 3, showing an embodiment with electromagnetic locking means.

In FIG. 4 we have shown a further locking arrangement 31 comprising a ferromagnetic armature 18 lodged in carrier 2, this armature confronting in the normal carrier position a horseshoe-shaped electromagnet 19 provided with an excitation winding 119. The latter is energizable, in the "OFF" position of the aforementioned START/STOP switch 40, via a circuit 4' extending from supply conductor 20 to the grounded supporting bar 6. Corresponding circuits 4' for the other thread guards mounted on bar 6 have also been indicated. Switch 40, in its illustrated "OFF" position, connects a voltage source—here shown as an a-c supply 37—to conductor 20.

Figure 5:
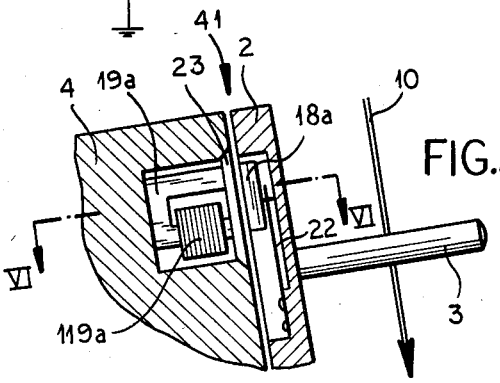
FIG. 5 is a view similar to part of FIG. 4, illustrating a modification of that embodiment.
Figure 6:
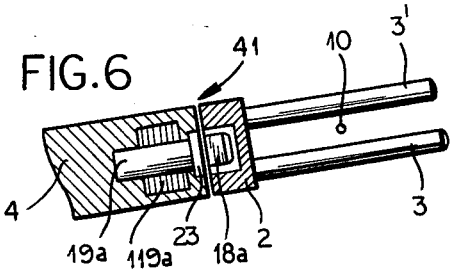
FIG. 6 is a cross-sectional view taken on the line VI—VI of FIG. 5.

The embodiment of FIG. 4 is relatively simple but requires a rather strong magnetic force in order to hold the carrier 2 securely in its normal position. Less force is required in a modified locking system 41 according to FIGS. 5 and 6 in which an electromagnet **19*a* with winding 119*a* normally confronts an armature 18*a* mounted in a cavity of carrier 2 on a leaf spring 22. Magnet 19*a* is recessed into support 4 behind a vertical channel 23 into which it attracts the armature 18*a* upon energization of winding 119*a*. This armature then positively retains the carrier 2** in its normal position.

Figure 7:
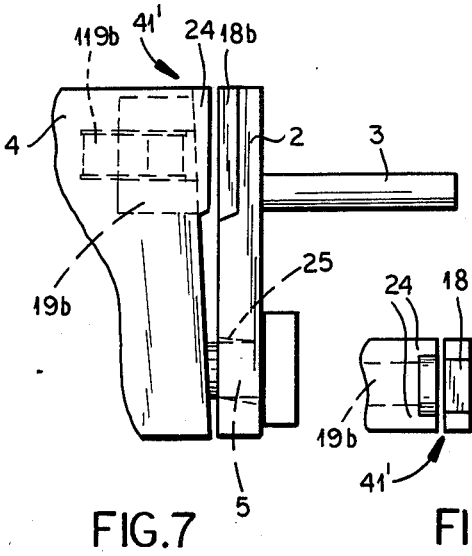
FIG. 7 is a fragmentary side-elevational view of a further embodiment with electromagnetic locking means.
Figure 8:
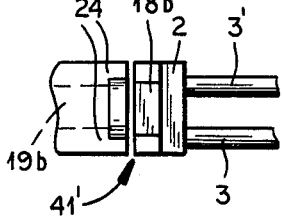
FIG. 8 is a fragmentary top view of the assembly of FIG. 7.

A similar locking system 41' has been illustrated in FIGS. 7 and 8 according to which an armature **18*b* is rigid with carrier 2, the latter having a somewhat enlarged bore 25 surrounding the shaft 5 with sufficient clearance to be tiltable in the axial plane of shaft 5 containing an electromagnet 19*b* with winding 119*b*. Ridges 24 projecting from support 4 on opposite sides of magnet 19*b* bracket the armature 18*b* when it is attracted by the magnet into its locking position. The center of gravity of carrier 2 and pins 3, 3' is so disposed as to tilt the carrier back into the unblocked position of FIGS. 7 and 8** when the magnet is de-energized.

Figure 9:
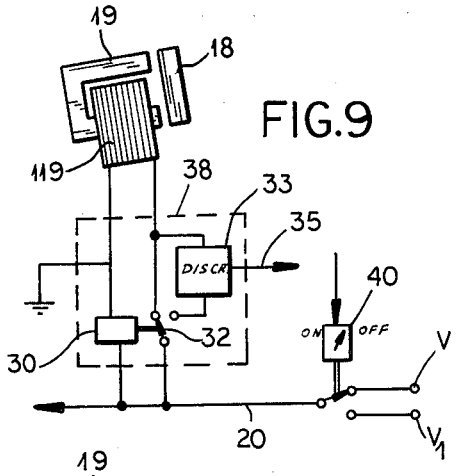
FIGS. 9–11 are diagrams of several signaling circuits associated with an electromagnetic locking device according to our invention.
Figure 10:
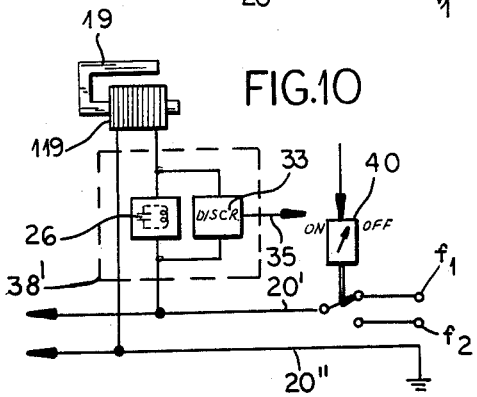
Figure 11:
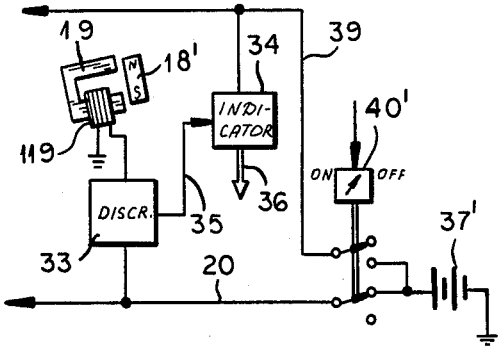

In FIGS. 9–11, where an electromagnet 19 with winding 119 and armature 18 is representative of any of the magnetic locking systems illustrated in FIGS. 4–8, this winding also serves to generate an alarm signal when the carrier 2 is swung into its off-normal position in the event of a thread break. According to FIG. 9, a signaling circuit 38 includes a relay 30 and a discriminator 33 which is connectable in series with winding 119 by a contact 32 of relay 30 when the latter is released. Switch 40, when in its "ON" position, applies to conductor 20 a relatively low voltage $V_1$ insufficient to operate the relay 30 or to immobilize the armature 18. With discriminator 33 connected in the signaling circuit by relay contact 32, voltage v allows that discriminator to detect a decrease in the inductance of winding 119 when armature 18 is swung out of alignment with electromagnet 19. An output lead 35 of discriminator 33 then triggers an indicator 34, shown in FIG. 11, whose own output 36 may turn on a signal lamp or else turn off a roller drive advancing the threads **10*a* and 10*b* of FIG. 12. With switch 40 in its "OFF" position, however, the high voltage v operates the relay 30 to energize the winding 119 independently of discriminator 33 in order to arrest the armature 18** as described above.

In FIG. 10 we have shown a modified signaling circuit 38' including a reactive network 26 of the parallel-resonant type connected in shunt with discriminator 33 between winding 119 and a supply conductor 20'; winding 119 is also connected to a ground lead 20''. Switch 40, when in its illustrated "OFF" position, connects supply conductor 20' to a source of alternating voltage of a first frequency $f_1$ which readily passes the network 26 and energizes the winding 119 to arrest the pin carrier of the thread guard as described above; discriminator 33 is virtually short-circuited by network 26 under these conditions. When, however, switch 40 is in its "ON" position, another frequency $f_2$ is supplied to circuit 38' via conductor 20' and is substantially blocked by network 26 so as to pass the discriminator 33 in series with winding 119; the resistance of that discriminator is sufficient to prevent the immobilization of the carrier in that instance while enabling detection of a movement of the associated armature out of alignment with electromagnet 19.

According to FIG. 11, an armature 18' confronting the electromagnet 19 is designed as a permanent magnet. A modified control switch 40', when in its "ON" position, applies operating voltage via a lead 39 to alarm indicators 34 of all thread guards from a d-c source 37' which is disconnected in that position from conductor 20. When armature 18' is disaligned from magnet 19, the resulting change in the magnetic field traversing the winding 119 induces a pulse exciting the discriminator 33 to trigger the associated alarm indicator 34. This pulse, to be sure, will also be transmitted by way of conductor 20 to all other discriminators and windings connected thereto; because of the large number of circuits branching off conductor 20, however, the pulse will be greatly attenuated and therefore ineffectual in these other circuits. In its "OFF" position, switch 40' energizes winding 119 in series with discriminator 33 which, however, cannot trigger the indicator 34 under these conditions in view of the de-energization of lead 39.

It will be understood that switch 40 or 40' of FIGS. 4 and 9–11 may be replaced by the switch 52 of FIG. 12, or some modification thereof, to control the energization of the various windings 119, **119*a*, 119*b* in accordance with significant speed changes of motor 46 or of some other driver imparting tension to the monitored yarn. It is also possible to let the START/STOP switch 40 or 40'** perform its described functions not directly but through a slow-operating or slow-releasing relay designed to maintain the energization of the electromagnet for a predetermined period after any restarting of the machine.

We claim:

1. In textile machinery wherein two threads merge at a junction into a yarn by the action of drawing means engaging said yarn under tension downstream of said junction, the combination therewith of:

a support;

a thread guard comprising a carrier swingable on said support about an axis at least generally perpendicular to the path of the yarn between a normal metastable position and an off-normal position, said carrier being provided with a guide bracketing the yarn and permitting same to run through said thread guard in said normal position and entangling the threads to cause rupture thereof under the force of said drawing means in said off-normal position;

means connected to said guard for monitoring the threads and for displacing said guide from said normal position to said off-normal position when one of said threads ruptures so that said guide ruptures the other thread;

locking means on said support activatable for engaging said carrier and immobilizing same in said normal position; and switch means operatively coupled with said drawing means for automatically activating said locking means and engaging same with said carrier to immobilize same only upon a significant slackening of the tension exerted upon the yarn during normal operation of said drawing means.

2. The combination defined in claim 1 wherein said locking means comprises a detent engageable with said carrier.

3. The combination defined in claim 2 wherein said detent is fluidically actuatable by said switch means.

4. The combination defined in claim 1 wherein said locking means comprises an electromagnet confronting an armature on said carrier in said normal position thereof, said electromagnet having winding means energizable by said switch means.

5. The combination defined in claim 4 wherein said armature is attractable by said electromagnet into positive engagement with a retaining formation on said support.

6. The combination defined in claim 4, further comprising a signaling circuit including said winding means sensing a disalignment of said armature from said electromagnet upon a swing of said carrier into said off-normal position.

7. The combination defined in claim 6 wherein said signaling circuit includes a discriminator responsive to an electrical change induced in said winding means by said disalignment, further comprising rupture-indicating means triggerable by said discriminator.

8. The combination defined in claim 7 wherein said signaling circuit further includes inhibiting means controlled by said switch means for disabling said discriminator in a state of energization of said winding means immobilizing said carrier in said normal position.

9. The combination defined in claim 8 wherein said signaling circuit includes a supply conductor alternately connectable by said switch means to sources of relatively low and relatively high voltage, said inhibiting means comprising a relay inserted between said conductor and said winding means, said relay being operable by said relatively high voltage for disconnecting said discriminator from said conductor and being released in the presence of said relatively low voltage with resulting insertion of said discriminator between said conductor and said winding means, said relatively low voltage being insufficient to cause retention of said carrier in said normal position.

10. The combination defined in claim 8 wherein said signaling circuit includes a supply conductor alternately connectable by said switch means to sources of a first and a second frequency, said inhibiting means comprising a reactive network connected in shunt with said discriminator between said conductor and said winding means, said reactive network having a relatively low impedance at said first frequency and a relatively high impedance at said second frequency whereby said discriminator is effectively short-circuited and said winding means is energized sufficiently to immobilize said carrier only in the presence of said first frequency.

11. The combination defined in claim 7 wherein said signaling circuit includes a supply conductor connected to said winding means by way of said discriminator, said switch means having a first position for energizing said rupture-indicating means while de-energizing said conductor and having a second position for de-energizing said rupture-indicating means while energizing said conductor, said armature being permanently magnetic for inducing in said discriminator a pulse upon disalignment from said electromagnet in said first position of said switch means.

12. The combination defined in claim 1 wherein said carrier is an elongate member swingable about said axis in a substantially vertical plane through half a turn between said normal and off-normal positions.

13. The combination defined in claim 12 wherein said guide means comprises a pair of pins projecting from said member parallel to said axis.

14. The combination defined in claim 12 wherein said locking means comprises a pair of lugs bracketing said member on a shaft transverse to said axis, said lugs being normally withdrawn from said substantially vertical plane.

15. The combination defined in claim 12 wherein said member is rigid with a shaft journaled in said support along said axis, said locking means comprising an indexing element engageable with said shaft.

16. The combination defined in claim 15 wherein said locking means further comprises an inflatable tube coacting with said indexing element.

17. The combination defined in claim 1 wherein said thread guard is one of a set of substantially identical thread guards monitoring respective yarns and provided with individual locking means jointly activable by said switch means.

18. The combination defined in claim 17 wherein said thread guards are disposed in a row, said individual locking means being operable by a common actuator extending along said row.

19. In combination with a drawing machine that pulls in two threads so that they merge at a junction into a yarn, a thread guard comprising:

a support, the threads normally being pulled by the drawing machine past the support;

a guide displaceable on the support between a normal position permitting the threads to pass the support on the way to the drawing machine and an off-normal position tangling with the threads;

means for monitoring the threads upstream of the drawing machine for displacing the guide from its normal position to its off-normal position when one of the threads breaks; and means for monitoring the speed of said drawing machine and for immobilizing the guide in the normal position when the monitored speed is below a predetermined threshold limit.

20. In combination with a drawing machine energizable to pull in two threads so that they merge at a junction into a yarn, a thread guard comprising:

a support, the threads normally being pulled by the drawing machine past the support;

a guide displaceable on the support between a normal position permitting the threads to pass the support on the way to the drawing machine and an off-normal position tangling with the threads;

means for monitoring the threads upstream of the drawing machine for displacing the guide from its normal position to its off-normal position when one of the threads breaks; and means connected to the drawing machine for immobilizing the guide in the normal position when the drawing machine is deenergized.

* * * * *